US008425148B2

(12) United States Patent
DiTullio

(10) Patent No.: US 8,425,148 B2
(45) **Date of Patent: *Apr. 23, 2013**

(54) STORM WATER RETENTION CHAMBERS WITH ARCH SHAPED ROW CONNECTOR AND METHOD OF CONNECTING MOLDED CHAMBER STRUCTURES

(76) Inventor: Robert J. DiTullio, Warren, CT (US)

( * ) Notice: Subject to any disclaimer, the term of this patent is extended or adjusted under 35 U.S.C. 154(b) by 446 days.

This patent is subject to a terminal disclaimer.

(21) Appl. No.: 12/757,510

(22) Filed: Apr. 9, 2010

(65) Prior Publication Data

US 2010/0196099 A1 Aug. 5, 2010

Related U.S. Application Data

(63) Continuation of application No. 11/452,561, filed on Jun. 14, 2006, now Pat. No. 7,806,627, which is a continuation-in-part of application No. 10/392,581, filed on Mar. 20, 2003, now Pat. No. 7,226,241.

(51) Int. Cl.
*E02B 11/00* (2006.01)

(52) U.S. Cl.
USPC ..... 405/49; 405/46

(58) Field of Classification Search ..... 405/43, 405/45, 46, 48, 49; 210/170.03, 170.1
See application file for complete search history.

(56) References Cited

U.S. PATENT DOCUMENTS

| | | | | |
|---|---|---|---|---|
| 2,153,789 | A | 4/1939 | Carswell et al. | |
| 2,767,801 | A | 10/1956 | Eads | |
| 3,897,090 | A | 7/1975 | Maroschak | |
| 3,926,222 | A | 12/1975 | Shroy et al. | |
| 4,192,628 | A | 3/1980 | Gorman | |
| 4,598,277 | A * | 7/1986 | Feldman | 405/43 |
| 5,087,151 | A | 2/1992 | DiTullio | |
| 5,156,488 | A | 10/1992 | Nichols | |
| 5,419,838 | A | 5/1995 | DiTullio | |
| 5,773,756 | A | 6/1998 | DiTullio | |
| 5,890,838 | A | 4/1999 | Moore, Jr. et al. | |
| 6,129,482 | A | 10/2000 | DiTullio | |
| 6,322,288 | B1 | 11/2001 | DiTullio | |
| 6,361,248 | B1 | 3/2002 | Maestro | |
| 6,612,777 | B2 | 9/2003 | Maestro | |
| 6,692,186 | B1 * | 2/2004 | Suazo et al. | 405/49 |
| 7,008,138 | B2 | 3/2006 | Burnes et al. | |
| 7,025,532 | B2 | 4/2006 | Suazo et al. | |

(Continued)

FOREIGN PATENT DOCUMENTS

DE 202005010090 U1 9/2005

OTHER PUBLICATIONS

Cultec, Inc.; Cultec Patented Interlocking Rib Connection (printout from www.cultec.com web pages); Oct. 2001.

(Continued)

*Primary Examiner* — Michael Safavi
(74) *Attorney, Agent, or Firm* — St. Onge Steward Johnston & Reens LLC

(57) ABSTRACT

A connection chamber for waste water and storm water collection, the connection chamber including an arch-shaped cut out in a side thereof, the arch-shaped cut out sized to receive an arch-shaped row connector, which is provided to couple rows of chambers to each other. The coupling of various rows of chambers to each other facilitates the relatively even flow of fluid throughout the field of chambers.

9 Claims, 5 Drawing Sheets

U.S. PATENT DOCUMENTS

| | | | |
|---|---|---|---|
| 7,517,172 | B2 | 4/2009 | Sipaila |
| 2002/0025226 | A1 | 2/2002 | Maestro |
| 2002/0044833 | A1 | 4/2002 | Kruger et al. |
| 2003/0095838 | A1 | 5/2003 | Maestro |
| 2003/0219310 | A1 | 11/2003 | Burnes et al. |
| 2004/0184884 | A1 | 9/2004 | DiTullio |
| 2005/0074287 | A1 | 4/2005 | Brochu et al. |
| 2005/0100410 | A1 | 5/2005 | Maestro |
| 2005/0238434 | A1 | 10/2005 | Coppes et al. |

OTHER PUBLICATIONS

Cultec, Inc.; Plastic Septic and Stormwater Chambers (printout from www.cultec.com web pages); Sep. 2002.

St. Marseille, J.G.; Anderson, B.C.; Use of Leaching Chambers for On-Site Sewage Treatment; 2002; Environmental Technology, vol. 23, pp. 261-272.

* cited by examiner

STORM WATER RETENTION CHAMBERS WITH ARCH SHAPED ROW CONNECTOR AND METHOD OF CONNECTING MOLDED CHAMBER STRUCTURES

CROSS REFERENCE TO RELATED APPLICATIONS

This application is a continuation of U.S. patent application Ser. No. 11/452,561 filed Jun. 14, 2006, now U.S. Pat. No. 7,806,627 filed in the name of Robert J. DiTullio and entitled "Storm Water Retention Chambers", which is a continuation-in-part of U.S. patent application Ser. No. 10/392,581 filed Mar. 20, 2003 and issued as U.S. Pat. No. 7,226,241 dated Jun. 5, 2007, filed in the name of Robert J. DiTullio and entitled "Storm Water Chamber for Ganging Together Multiple Chambers", the content of which is incorporated herein by reference.

FIELD OF THE INVENTION

The present invention relates generally to septic systems, and more particularly to a leaching or drainage system for a septic system which uses lightweight, molded chamber structures, which chamber structures are positioned so as to form an interconnected field for efficient distribution of fluid entering the chamber structures.

BACKGROUND OF THE INVENTION

Molded chamber structures are increasingly taking the place of concrete structures for use in leaching fields or to gather stormwater run off. Molded chamber structures provide a number of distinct advantages over traditional concrete tanks. For example, concrete tanks are extremely heavy requiring heavy construction equipment to put them in place. In leaching fields and stormwater collection systems, the gravel used in constructing them is difficult to work with and expensive. It also tends to settle and reduces the overall volume of the trench by as much as 75%.

Attempts have been made to overcome the limitations that are attendant upon the use of traditional septic systems. U.S. Pat. No. 5,087,151 to DiTullio ("the '151 patent"), which represents one such attempt, discloses a drainage and leaching field system comprising vacuum-molded polyethylene chambers that are designed to be connected and locked together in an end-to-end fashion. The chambers comprise a series of pre-molded polyethylene bodies with an arch-shaped configuration having upstanding ribs running transverse to the length of the chamber. The ribs provide compressive strength to the chamber so as to inhibit crushing of the chamber by the weight of earth under which it is buried, as well as the weight of persons, vehicles, etc. which pass over the buried chamber. The rib at an end portion of the chambers is provided slightly smaller than the remaining ribs so that to connect the chambers to one another in an end-to-end fashion, one need simply position the first rib of one chamber over the slightly smaller rib on a second chamber. This may be referred to as an overlapping rib connection. The chambers are typically positioned in a trench on top of a bed of materials that facilitates the flow of fluid into the earth.

While the drainage and leaching field system disclosed in the '151 patent provides numerous benefits over traditional systems, including the provision of a lightweight, easy to install and structurally sound system, the system disclosed in the '151 has been improved upon, which improvements form the basis of the present invention. More specifically, it has been recognized that it is desirable to increase the flow of effluent or stormwater from chamber to chamber. For example, it is known to connect chambers in an end-to-end fashion as disclosed in the '151 patent, thereby providing for the free flow of fluid along that particular row of connected chambers. However, each separate row of chambers has typically been connected to one or more adjoining rows of chambers by relatively small diameter pipe. While the chambers themselves are relatively large to accommodate a large volume of fluid, the pipes interconnecting the different rows of chambers restrict the free flow of fluid throughout the field. In addition, traditionally the interconnecting pipes have been positioned relatively high on the chambers. This means that fluid flow between the chambers will not occur until the fluid level rises at least to the level of the interconnecting pipe. This is undesirable because the fluid is not uniformly distributed throughout the field but instead is maintained generally at the end where the input pipe is located. Another problem with this configuration is that fluid "falling" out of the interconnecting pipe to the floor into the next row of chambers, has a tendency to undermine the base that the chamber sits on creating a situation in which the system may begin to sink.

Another problem with the interconnecting pipes is that any penetration of the side walls of the chambers has traditionally caused an unacceptable weakening in the chamber. Accordingly, in order to maintain the structural integrity of the chamber, interconnecting pipes have traditionally been restricted to entering the ends of the chamber rows. However, depending upon the configuration of the jobsite, this is not always convenient or even possible.

Therefore, what is desired is a system that facilitates the generally even distribution of fluid throughout a drain field or leaching field using molded chamber structures.

It is further desired to provide a system that facilitates the even distribution of fluid throughout a drain field or leaching field while at the same time not reducing the structural integrity of the molded chamber structures.

It is still further desired to provide a system that facilitates the even distribution of fluid throughout a drain field or leaching field while at the same time reduces or substantially eliminates any undermining of and/or damage to the bed upon which the molded chamber structures are positioned.

It is yet further desired to provide a drain field or leaching field system utilizing molded chamber structures that allows for increased variability in the layout and positioning of the molded chamber structures.

SUMMARY OF THE INVENTION

These and other objects are achieved in one advantageous embodiment by the provision of a connection chamber that may be inserted in a row of molded chamber structures. The connection chamber in similar in construction with the standard molded chamber structures, however, includes an arch-shaped cut out in at least one side wall for receiving an arch-shaped row connector therein. In this manner, multiple connection chambers may be used to connect multiple rows of chambers by means of row connectors extending between each row of chambers.

It is contemplated that the connection chambers may include an end wall at each end of the connection chambers, providing increased strength and support. However, such end walls are not required. When end walls are provided, such as integrally molded end walls, various pre-formed cut outs may be provided in the end walls, which may be cut depending upon the application. For example, it may be desirable to cut out a portion of the lower part of the end wall to allow free flow of fluid along a length of the connection chamber to the molded chamber structure to which it is connected. Alternatively, the end walls may be provided as separate insertable pieces also provided with pre-formed cut outs therein.

It is further contemplated that the length of the connection chambers may, in one advantageous embodiment, be provided shorter than a length of the standard molded chamber structures that it is connected with. The connection chambers are provided with a plurality of upstanding ribs, providing increased strength to the structure.

The arch-shaped cut out provided at a bottom portion in the sidewall of the connection chambers is sized to receive an arch-shaped row connector, which may be formed as a miniature molded chamber structure. The row connector may or may not be provided with end wall sections. In either event, once the arch-shaped cut out is removed by the user, an end of the row connector may be inserted therein providing a continuous connection from one row to the next. The row connector is arch-shaped, including the plurality of upstanding ribs and therefore provides a very sturdy connection from row to row. In addition, as the ends of the row connector are positioned in relatively close tolerance within the arch-shaped cut out of the connection chambers, the side walls of the row connectors are prevented from spreading upon the application of a relatively large downward force. While the connection chambers have had portions of the side walls removed, the insertion of the row connectors into the cut out also provides support to the connections chambers themselves. It is further contemplated that the row connectors may further by attached to the connection chambers providing even further support to the system.

Advantageously, the arch-shaped cut out for the connection chambers is provided at a lower portion of the side wall. In this manner, a continuous connection from row to row is provided such that, fluid flowing from chamber to chamber and from row to row may easily run along the top of the bed of materials the chambers are resting upon. This is advantageous as the fluid may then be fairly evenly distributed among the rows of chambers while at the same time not compromising the integrity of the chambers.

In one advantageous embodiment, a system for using molded chamber structures to collect waste water or storm water is provided comprising an arch-shaped connection chamber. The arch-shaped connection chamber is provided with an elongated body portion including a plurality of upstanding ribs positioned along a length thereof and an open bottom. The connection chamber is further provided with an end rib, positioned at one end of the elongated body portion, the end rib being smaller than the plurality of ribs and designed to mate with a larger rib at an end of a chamber structure to couple the connection chamber to the chamber structure in an end-to-end fashion. The connection chamber is still further provided with a first arch-shaped cut out positioned at a bottom portion in a side wall of the connection chamber.

In another advantageous embodiment, an arch-shaped connection chamber for coupling together rows of molded chamber structures is provided comprising a body portion including an open bottom, and an upstanding end rib, positioned at one end of said body portion, the end rib designed to mate with a starting rib at an end of a chamber structure to couple the connection chamber to the chamber structure in an end-to-end fashion. The connection chamber further comprises a first arch-shaped cut out positioned at a bottom portion in a side wall of the connection chamber, the cut out formed to engage with an arch-shaped row connector.

In still another advantageous embodiment, a method of connecting molded chamber structures to each other is provided comprising the steps of coupling a first connection chamber to a first row of chamber structures in an end-to-end fashion, and coupling a second connection chamber to a second row of chamber structures in an end-to-end fashion. The method further comprises the steps of providing an arch-shaped cut out in a side wall of the first and second connection chambers, the arch-shaped cut outs positioned at lower portions of the side walls, and coupling the first connection chamber to the second connection via an arch-shaped row connector.

Other objects of the invention and its particular features and advantages will become more apparent from consideration of the following drawings and accompanying detailed description.

DETAILED DESCRIPTION OF THE INVENTION

Figure 1:
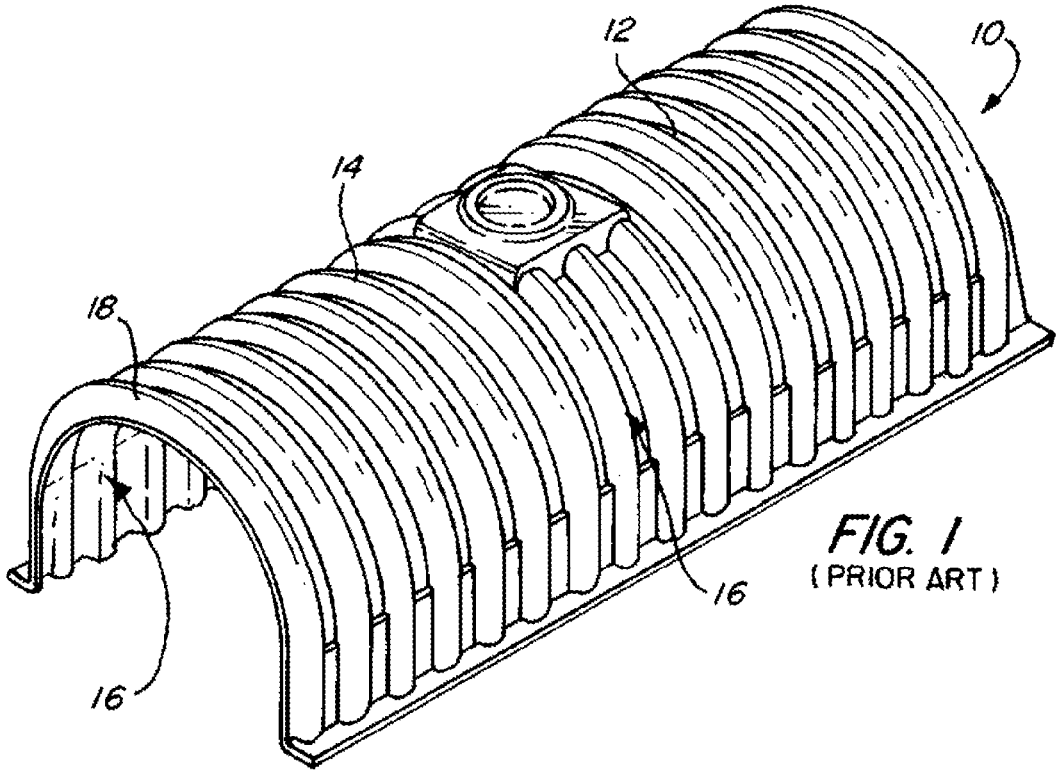
FIG. 1 (PRIOR ART)
FIG. 1 is an illustration of a molded chamber structure according to the prior art.

Referring now to the drawings, wherein like reference numerals designate corresponding structure throughout the views.

FIG. 1 is an illustration of a molded chamber structure 10 according to the prior art. As can be seen from the illustration, the molded chamber structure 10 generally comprises an arch-shaped body portion 12 that includes a plurality of upstanding ribs 14. The body portion 12 is provided with an open bottom such that side walls 16 essentially rest on the surface of the bed of materials. The molded chamber structure 10 may or may not be provided with an end wall.

Figure 2:
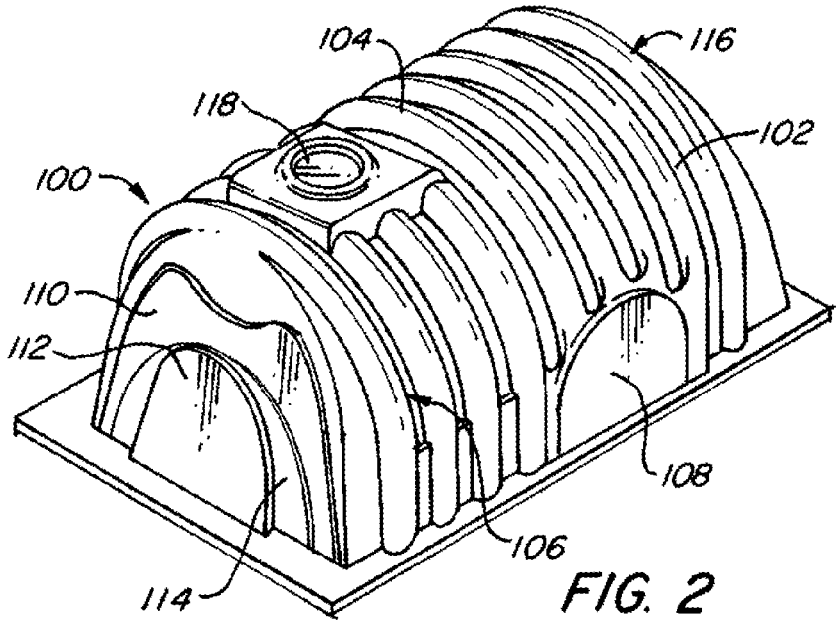
FIG. 2 is an illustration of a connection chamber according to an advantageous embodiment of the present invention.

Molded chamber structure 10 is provided with a starting rib 18, which is designed to mate with end rib 116 on connection chamber 100 (FIG. 2). Molded chamber structure 10 typically comprises, for example, a vacuum-molded polyethylene chamber. However, other polymer materials may be used, including injection molded polypropylene.

Turning now to FIG. 2 connection chamber 100 is illustrated. Connection chamber 100 generally comprises an arch-shaped body portion 102 including a plurality of upstanding ribs 104. Connection chamber 100 also comprises side walls 106, which extend downward to rest on the surface of the bed of materials having an open bottom.

Provided at a lower portion of side wall 106 is arch-shaped cut out 108. In one advantageous embodiment, cut out 108 may be formed as a relatively flat pre-formed section that may be removed by the user depending upon the application. It is further contemplated that two arch-shaped cut outs 108 may be provided opposite each other on connection chamber 100. In this manner, the cut outs 108 may individually be removed depending upon the positioning of the connection chamber 100 in the field provide improved versatility to the user.

Also depicted in FIG. 2 is end wall 110. It is contemplated that end wall 110 may be integrally molded with arch-shaped body portion 102, or alternatively, may be provided as a removable wall section. End wall 110 may further be provided with pre-molded cut outs, which may variously be used as needed. For example, a relatively small arch-shaped cut out 112 may be provided at a lower end of end wall 110, or a relatively large arch-shaped cut out 114 may be provide at a lower end of end wall 110. These are just two examples of cut out configurations that may be provided in end wall 110. It is contemplated that many differing designs may advantageously be used.

It is contemplated that, in one advantageous embodiment, connection chamber 100 may comprise, for example, a vacuum-molded polyethylene material. An inspection port 118 may further be provided on an upper surface of arch-shaped body portion 102. The inspection port 118 is provided such that a user may visually inspect the interior of the connection chamber 100 and correspondingly coupled molded chamber structures 10.

Figure 3:
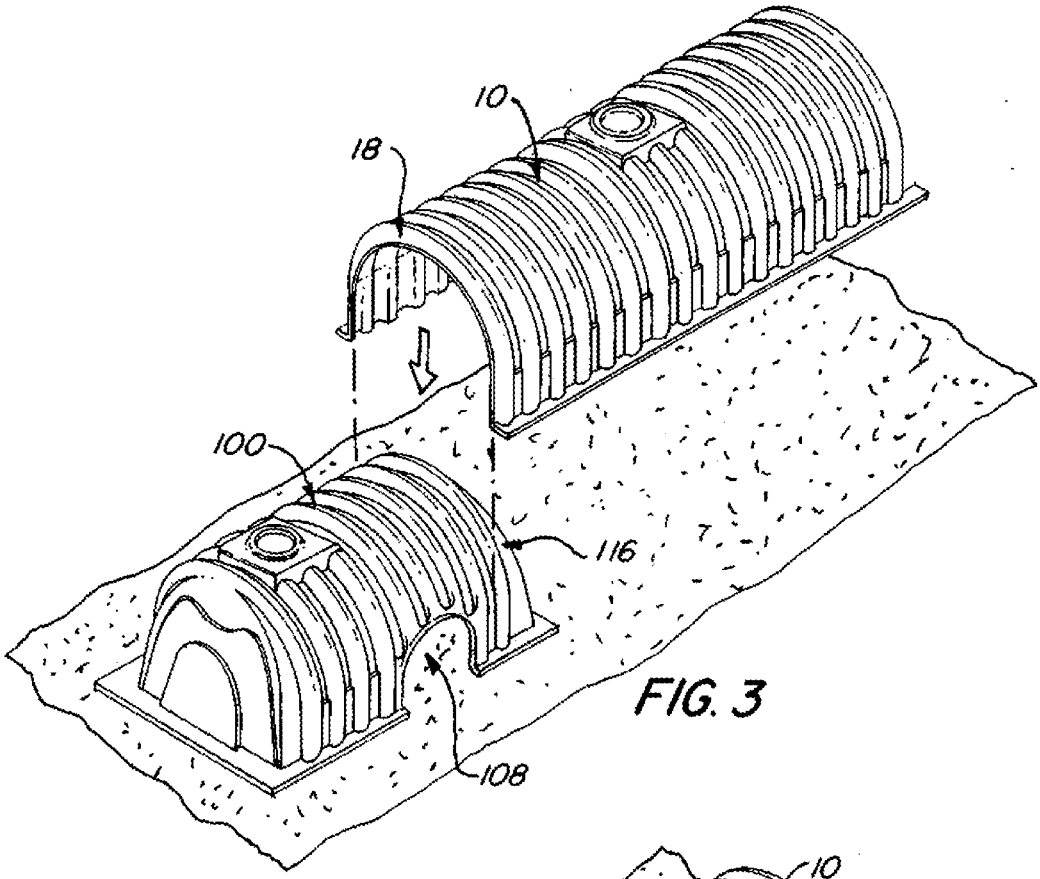
FIG. 3 is an illustration of how the connection chamber of FIG. 2 is connected to a molded chamber structure.
Figure 4:
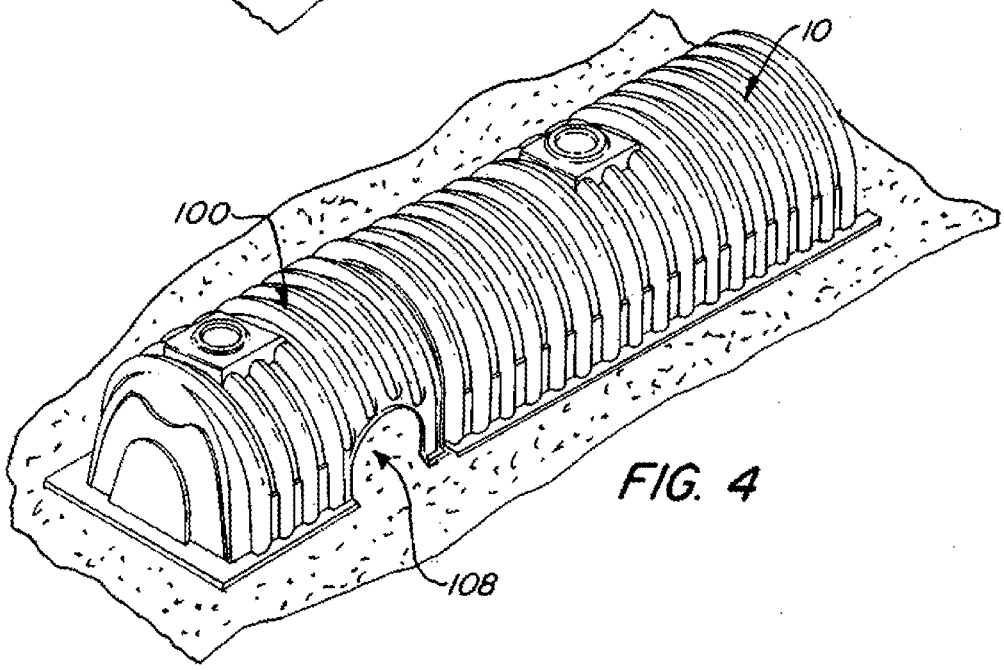
FIG. 4 is an illustration according to FIG. 3 of the connection chamber coupled to a molded chamber structure.

Also provided on connection chamber 100 is end rib 116, which is located at one end of arch-shaped body portion 102. End rib 116 is provided as a smaller rib than that plurality of upstanding ribs 104. In this manner, end rib 116 may be mated with starting rib 18 provided on molded chamber structure 10. Connection is relatively simple and quick. The molded chamber structure 10 may simply be dropped down over connection chamber 100 as shown in FIG. 3, to form a chamber row (FIG. 4).

While connection chamber 100 is illustrated connected to one end of molded chamber structure 10, it is contemplated that it may be positioned anywhere along the length of the row and that multiple connection chambers 100 may be utilized in a single row to facilitate the free movement of fluid throughout the field.

Figure 5:
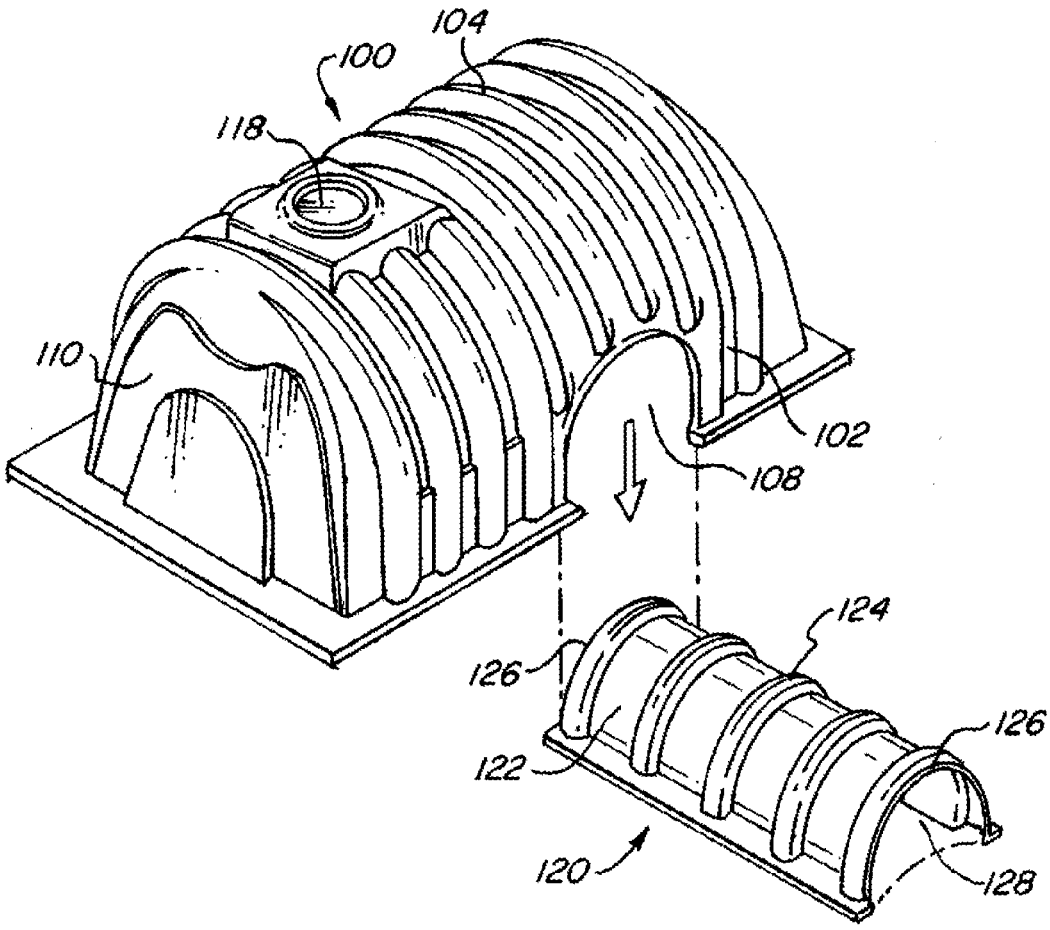
FIG. 5 is an illustration of how a row connector couples to a connection chamber according to FIG. 2.

Referring now to FIG. 5, connection chamber 100 is illustrated along with row connector 120. Connection chamber 100 is shown with arch-shaped cut out 108 removed. Row connector 120 is sized to fit into cut out 108 with relatively tight tolerance. As can be seen from the illustration, row connector 120 generally comprises a body portion 122 with a plurality of upstanding ribs 124.

Provided at either end of row connector 120 is an end rib 126. It is contemplated that cut out 108 is sized to closely match the arch-shaped contour of body portion 122. In this manner, when the arch-shaped cut out 108 is positioned over to settle between upstanding ribs 124, (in particular between end rib 126 and the next rib of the plurality of upstanding ribs 124), row connector 120 cannot be withdrawn from cut out 108 without connection chamber 100 first being lifted upward to clear end rib 126.

This interlocking feature provides a secure connection between connection chamber 100 and row connector 120. This is especially advantageous when, during backfilling of the excavation, the dirt may have a tendency to laterally push against the chamber structures. It is important to avoid any fill from entering the interior of the chambers as that will diminish the capacity of the chamber system and impede the free flow of fluid throughout the field. Therefore, an interlocking system that substantially prevents lateral movement of row connector 120 is highly advantageous.

It is further contemplated that row connector 120 may or may not be provided with an end wall 128, which is illustrated as in dashed line in FIG. 5. The relatively close tolerance of cut out 108 not only interacts with end rib 126 to prevent withdrawal of row connector 120 from cut out 108, but also acts to prevent the side walls of row connector 120 from spreading apart relative to each other due to, for example, a downward load applied to the top of row connector 120. The end wall 128, when used, will further provide structural support to row connector 120.

It is contemplated that row connector 120, like connection chamber 100, may comprise, for example, a vacuum-molded polyethylene material.

Figure 6:
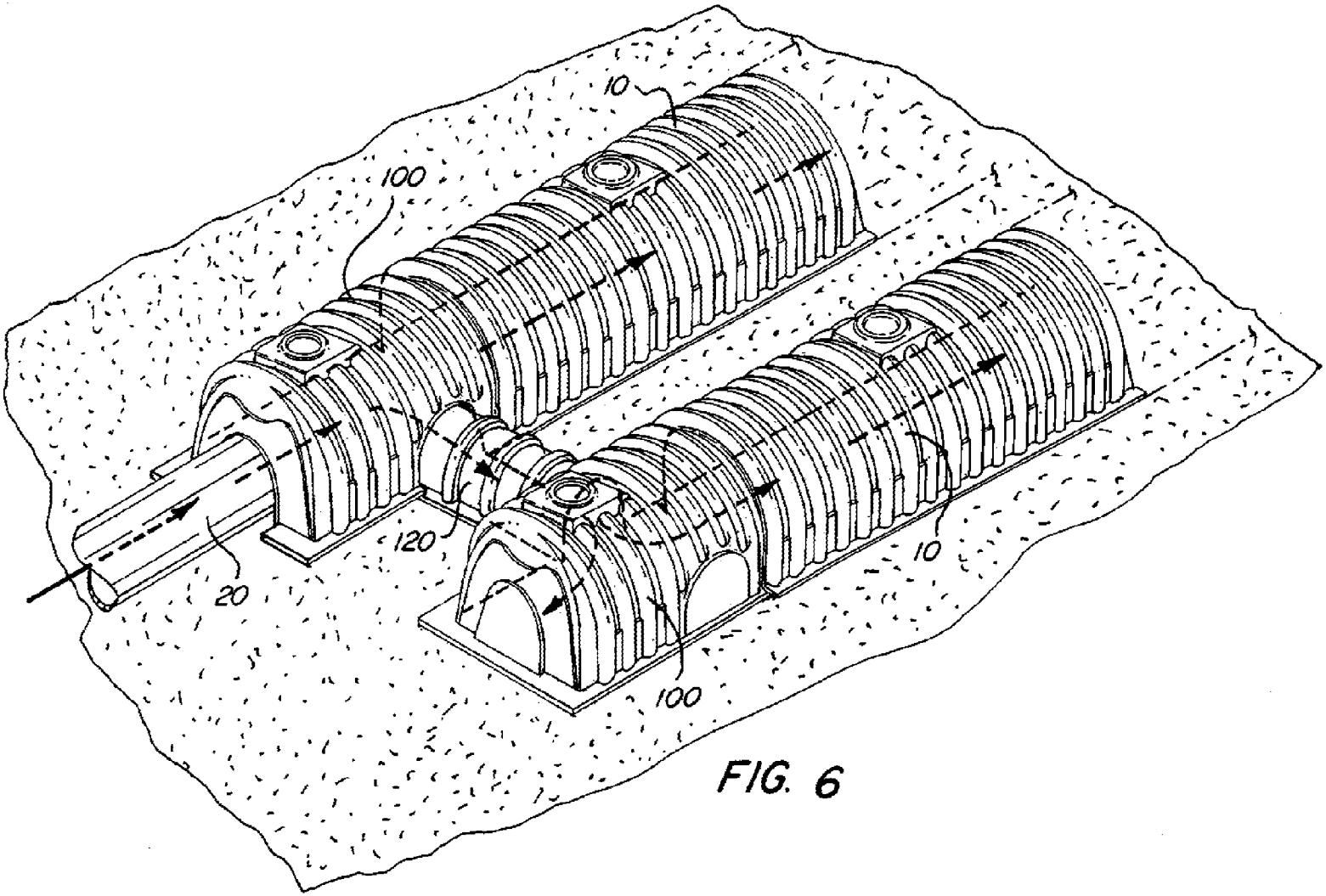
FIG. 6 is an illustration of a row connector coupling two rows of chambers together via two connection chambers according to FIG. 2.

Turning now to FIG. 6, a number of connection chambers 100, molded chamber structures 10, and a row connector 120 are illustrated in an interconnected arrangement. In this illustration, an inlet pipe 20 is shown entering one of the connection chambers 100. Arrows are provided to indicate the flow of fluid entering through inlet pipe 20, passing through a first connection chamber 100, and moving down the row. The fluid is also shown passing through row connector 120 into the second row of chambers. In this manner, the fluid may be as evenly distributed as possible throughout the field of chambers.

It is further contemplated that the inlet pipe 20 may further comprise a row connector 120, or that multiple inlets may be provided to the chambers to further evenly distribute the fluid throughout the field of chambers. Still further, multiple row connectors may be provided to connect rows to each other as desired.

Figure 7:
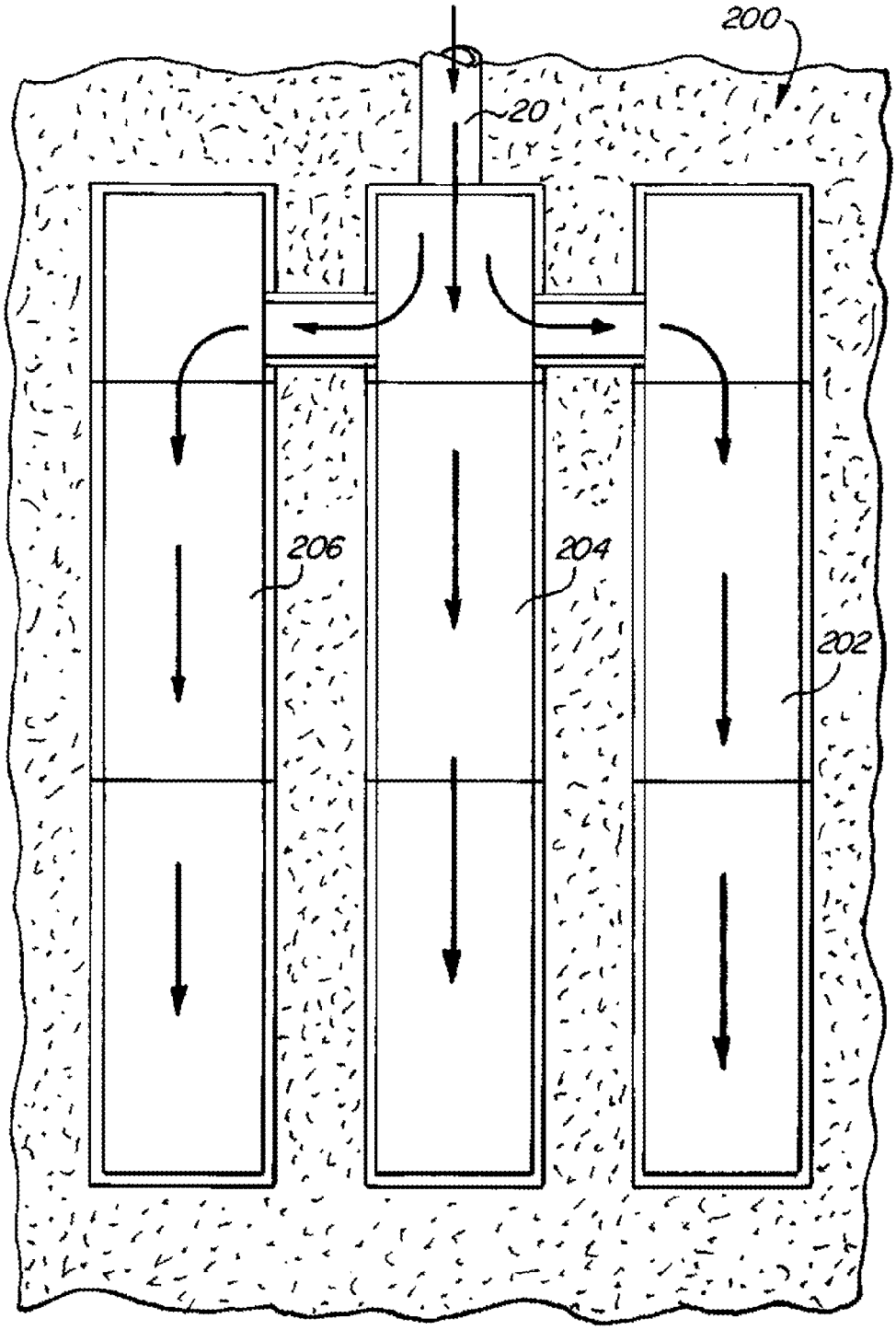
FIG. 7 is an overhead view of one field arrangement utilizing the chambers according to FIG. 6.

Referring now to FIG. 7, a field of chambers 200, is illustrated including a first row 202, a second row 204 and a third row 206 of interconnected chambers. In this configuration, inlet pipe 20 is shown feeding fluid into one end of second row 204. Second row 204 is coupled to first row 202 and third row 206 via row connectors 120. Accordingly, fluid entering second row 204 is not only transferred down the length of second row 204, but also to first row 202 and third row 206.

While connection chambers 100 are depicted at end positions relative to the three rows 202, 204, 206, it is contemplated that the connection chambers 100 may effectively be placed anywhere along the rows as desired or dictated by the particular job site.

This provides versatility to the user, where the interconnecting chambers may be laid out and fed in virtually any manner convenient. Due at least in part to the configuration of the connection chambers 100, even distribution throughout the chamber field is possible without compromising the structural integrity of the field of chambers.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A system for using molded chamber structures to collect waste water or storm water comprising:

a first arch-shaped connection chamber having:

an elongated body portion including a plurality of upstanding ribs positioned along a length thereof and an open bottom;

an end rib, positioned at one end of said elongated body portion, said end rib being smaller than said plurality of ribs and designed to mate with a larger rib at an end of a first water storage chamber structure to couple said connection chamber to the chamber structure in an end-to-end fashion; and a first arch-shaped cut out positioned at a bottom portion in a side wall of said connection chamber;

a second arch-shaped first connection chamber having:

an elongated body portion including a plurality of upstanding ribs positioned along a length thereof and an open bottom;

an end rib, positioned at one end of said elongated body portion, said end rib being smaller than said plurality of ribs and designed to mate with a larger rib at an end of a second water storage chamber structure to couple said connection chamber to the chamber structure in an end-to-end fashion; and a second arch-shaped cut out positioned at a bottom portion in a side wall of said second connection chamber; and an arch-shaped row connector having two ends, one end being positioned within said first arch-shaped cut out and another end being positioned within said second arch-shaped cut out, said first and second arch-shaped cut outs being positioned between upstanding ribs of said arch-shaped row connector such that said row connector cannot be withdrawn from said cut outs without said connection chambers being lifted upward above the upstanding ribs of said row connector.

2. The system according to claim 1 wherein fluid entering said system flows from said first chamber row to said second chamber row via said row connector along a bottom surface upon which the system is positioned.

3. The system according to claim 1 wherein said row connector further comprises an end wall.

4. The system according to claim 1 further comprising an end wall positioned at an end of said elongated body portion.

5. The system according to claim 1 further comprising an inspection port positioned on an upper portion of said elongated body portion of said first arch-shaped connection chamber.

6. A method of connecting molded chamber structures to each other comprising the steps of:

coupling a first connection chamber to a first row of chamber structures in an end-to-end fashion;

coupling a second connection chamber to a second row of chamber structures in an end-to-end fashion;

providing an arch-shaped cut out in a side wall of the first and second connection chambers, the arch-shaped cut outs positioned at lower portions of the side walls; and coupling the first connection chamber to the second connection chamber using an arch-shaped row connector having a plurality of upstanding ribs thereon;

wherein the arch-shaped cut outs of the first and second connection chambers engage between upstanding ribs on the arch-shaped row connector such that the row connector cannot be withdrawn from the cut outs without the connection chambers being lifted upward above the upstanding ribs of the row connector.

7. The method according to claim 6 further comprising the step of positioning an end wall at an end of the row connector.

8. The method according to claim 6 further comprising the step of positioning an end wall at an end of the first row of chamber structures.

9. The method according the claim 8 further comprising the step of positioning an end wall at an end of each chamber structure in the first row of chamber structures.

* * * * *